United States Patent [19]

Asai et al.

[11] 4,021,272

[45] May 3, 1977

[54] METHOD OF ISOTHERMAL ANNEALING OF BAND STEELS FOR TOOLS AND RAZOR BLADES

[75] Inventors: Yoshiteru Asai, Yonago; Sumio Yoshizoe, Yasugi, both of Japan

[73] Assignee: Hitachi Metals, Ltd., Japan

[22] Filed: Apr. 15, 1975

[21] Appl. No.: 568,197

[30] Foreign Application Priority Data

Apr. 19, 1974 Japan ..... 49-43389

[52] U.S. Cl. ..... 148/15; 148/20; 148/155; 148/156

[51] Int. Cl.[2] ..... C21D 1/48

[58] Field of Search ..... 148/15, 20, 155, 156, 148/157, 18, 20.6

[56] References Cited

UNITED STATES PATENTS

| | | | |
|---|---|---|---|
| 2,474,674 | 6/1949 | Holden | 148/15 |
| 3,290,184 | 12/1966 | Minck | 148/155 |
| 3,510,367 | 5/1970 | Berger | 148/15 |
| 3,826,694 | 7/1974 | Woodilla et al. | 148/15 |

FOREIGN PATENTS OR APPLICATIONS

| | | | |
|---|---|---|---|
| 269,187 | 7/1970 | U.S.S.R. | 148/15 |

*Primary Examiner*—Walter R. Satterfield

*Attorney, Agent, or Firm*—Craig & Antonelli

[57] ABSTRACT

A method consisting in converting a coil of hot-rolled band steel for tools and razor blades into an open coil in which its convolutions are spaced apart from one another, and immersing the open coil in a series of salt baths. First of all, the open coil is immersed for 5 to 30 minutes in a salt bath held at a temperature in a range from 550° to 750° C to preheat the open coil and cause preliminary precipitation of carbides. The preheated open coil is immersed for 5 to 30 minutes in a salt bath held at a temperature in a range from the temperature immediately above Acl point to the temperature of Acl point plus 50° C to make the band steel austenitic in structure. The open coil is then immersed for over 10 minutes in a salt bath held at a temperature in a range from the temperature immediately below Arl point to the temperature of Arl point minus 80° C so that the isothermal transformation may be completed. Finally, the open coil is immersed for 3 to 10 minutes in a salt bath held at a temperature in a range from 600° to 650° C and air cooled thereafter. The method enables to produce band steels for tools and razor blades which contain carbides occurring in a small spheroidal structure of uniform size, have good cold-workability, have freedom from decarburizing and carburizing, and have high amenability to hardening.

5 Claims, 6 Drawing Figures

(X 1000)

(X 1000)

(X 8000)

(X 8000)

METHOD OF ISOTHERMAL ANNEALING OF BAND STEELS FOR TOOLS AND RAZOR BLADES

This invention relates to a method of isothermal annealing of band steels adapted to produce tools and razor blades therefrom.

The structure of a hot-rolled steel in coil form adapted to produce tools and razor blades therefrom consists of martensite and retained austenite. The steel of such structure is not fit for cold-working, e.g. cold rolling or machining, and should therefore be subjected to some form of treatment to soften it. In the case of a band steel for producing tools and razor blades, the steel has to be subjected to heat treatment for converting all the carbides in the steel into a spheroidal structure of a proper size or spheroidizing annealing, in order to increase its cold-workability and make it better serve the purposes for which it is intended. Generally, in one method known in the art, the steel is held for a prolonged period of time at the temperature immediately above or below Acl in a furnace of the bell type or a continuous furnace of the roller hearth type and then cooled. In another method known in the art, it is repeatedly heated at a temperature immediately above or below Acl in said furnaces and cooled. These methods of the prior art have the following disadvantages:

1. A coil of band steel formed in convolutions has a very low heat transmissibility. Thus, it takes a long time to raise the temperature of the steel, maintain the steel at predetermined temperature ranges and cool the same, in order to produce a uniform microstructure and hardness in the outer portion, central portion and inner portion of the coil and in the central portion and end portions of its width. If the coil were made into an open coil in which its convolutions are spaced apart from one another and the atmospheric gas were vigorously agitated, the time required might be reduced to a certain degree. However, this would involve an increase in the size of the furnace and an increase in installation costs.

2. An atmospheric gas is used for preventing decarburizing and carburizing. However, the optimum composition of the gas may vary depending on the chemical composition of the steel and the temperature at which the steel is treated. This would complicate production management.

3. Great difficulty is experienced in producing a steel structure in which carbides have a small spheroidal structure. This makes it necessary to perform some other treatment if it is desired to produce a steel of the structure in which carbides have a small spheroidal structure.

It is generally known that, by subjecting a tool steel to isothermal annealing at a suitable heat cycle, it is possible to produce a steel structure in which carbides have a small spheroidal structure. However, owing to its low heat transfer rate and high mass effect, a coil of band steel cannot successfully be treated in a furnace of the bell type or a continuous furnace of the roller hearth type for effecting isothermal annealing which requires the operation of uniformly and quickly cooling the coil from the austenitic temperature to the isothermal transformation temperature.

A solution that comes to ones mind would be to convert the steel in coil form into strip form and pass it through a continuous furnace which is heated to predetermined temperatures of a suitable isothermal annealing cycle for treating it. However, this solution also has drawbacks. A hot-rolled band steel adapted to produce tools and razor blades therefrom is too high in hardness to make conversion of a coil into a strip practicable. It would take at least over 10 minutes for such steel to successfully undergo isothermal transformation. This would involve the use of a continuous furnace of a very great length and entail increased installation costs. Moreover, this solution would entail an increase in operation costs too, as compared with a conventional spheroidizing annealing process carried out in a furnace of the bell type.

One object of this invention is to provide a method of isothermal annealing of a coil of hot-rolled band steel for tools and razor blades which employs a salt bath for carrying out preliminary precipitation of carbides and isothermal annealing whereby the band steel produced by the method can contain carbides having a small spheroidal structure of uniform size and the band steel can also have good cold-workability and hardenability.

Another object of the invention is to provide a method of isothermal annealing of a coil of hot-rolled band steel for tools and razor blades which employs a plurality of salt baths each held at a predetermined temperature range for carrying out preliminary precipitation of carbides and isothermal annealing whereby the band steel containing carbides of a small spheroidal structure of uniform size and having good cold-workability and hardenability can be produced economically.

The invention is based on the discovery that the aforesaid disadvantages of the prior art can be obviated by using salt baths which permit uniform quick heating and quick cooling of a coil of hot-rolled band steel to be effected. According to the invention, a coil of hot-rolled band steel for producing tools and razor blades is converted into an open coil which is successively immersed for predetermined time intervals in salt baths each held at a predetermined temperature range according to a predetermined heat cycle whereby isothermal annealing of the band steel can be accomplished. The invention enables to produce a band steel of superb properties for producing tools and razor blades therefrom.

The method of isothermal annealing of band steels for producing tools and razor blades according to the invention will be described with reference to a preferred embodiment.

1. A coil of hot-rolled band steel is converted into an open coil so that its convolutions may be spaced apart from one another a distance great enough (a minimum of 2 millimeters) for the molten salts to pass therethrough.

2. The open coil is immersed for 5 to 30 minutes in a salt bath (No. 1) held at a temperature in a range from 550° to 750° C to preheat the open coil and cause preliminary precipitation of carbides. This treatment causes precipitation of minuscule nuclei which will later grow into carbides having a small spheroidal structure.

3. The open coil is immersed for 5 to 30 minutes in a salt bath (No. 2) held at a temperature in a range from the temperature immediately above Acl point to the temperature of Acl point plus 50° C to convert the steel of the open coil into austenitic in structure.

4. The open coil is immersed for over 10 minutes in a salt bath (No. 3) held at a temperature in a range from the temperature immediately below Arl point to the temperature of Arl point minus 80° C so that the isothermal transformation may be completed.

5. In case the temperature of the salt bath (No. 3) is over 700° C, there is the danger of oxide scale being formed on surfaces of the band steel during the step of air cooling which follows immersion in the No. 3 salt bath. Immersion of the open coil for 3 to 10 minutes in a salt bath (No. 4) held at a temperature in a range from 600° to 650° C prior to the air cooling will have effect in preventing oxide scale formation.

6. After the open coil is cooled to an optimum temperature level, it is immersed in water in a water tank to remove the salts retained on the surface of the band steel.

Figure 1:
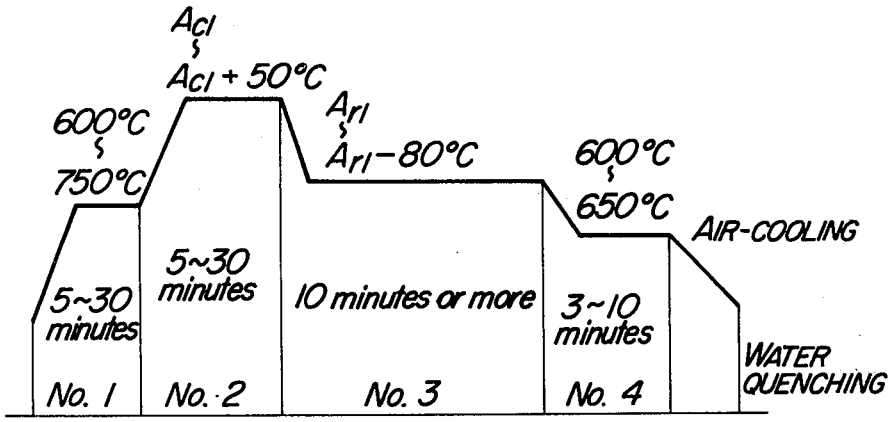
FIG. 1 is a diagram showing the heat cycle used by the method of isothermal annealing according to the present invention.
Figure 2:
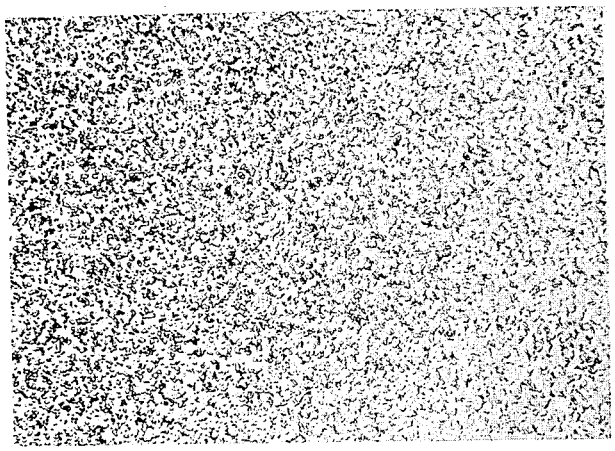
FIG. 2 and FIG. 3 are microscopic pictures showing the structures of tool steels produced by the method according to the invention.
Figure 3:
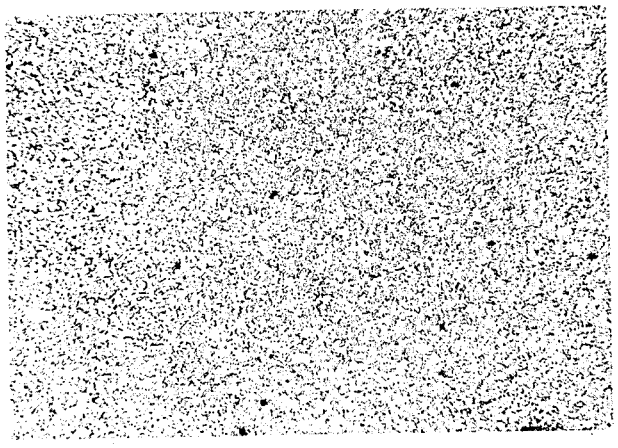

FIG. 1 shows the heat cycle used in the method of isothermal annealing according to the present invention. FIG. 2 and FIG. 3 show microscopic pictures of band steels for tools treated by the method according to the invention. FIG. 2 is a picture showing the microscopic structure, magnification 1,000 X, of a tool steel consisting of 1.15% carbon, 1.20% silicon, 0.4% manganese, 0.50% chromium, 1.50% tungsten and the balance iron. FIG. 3 is picture showing the microscopic structure, magnification 1,000 X, of a tool steel consisting of 1.25% carbon, 0.20% silicon, 0.20% manganese, 0.20% chromium and the balance iron.

Figure 4:
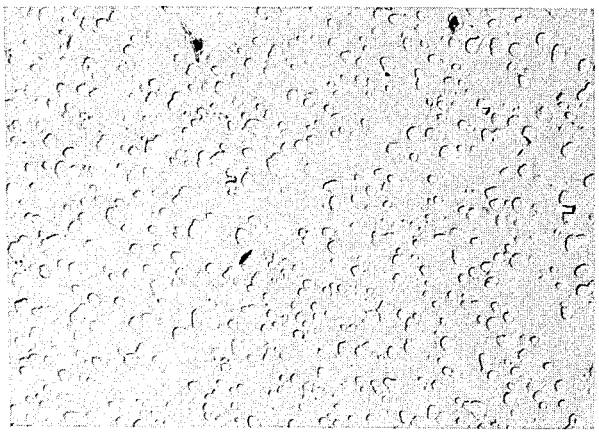
FIG. 4 is an electron microscopic picture showing the structure of a material for razor blades produced by the method according to the invention.

FIG. 4 shows an electron microscopic picture, magnification 8,000 X, of a material for razor blades made of a band steel for razor blades according to the invention and having a thickness of 0.10 millimeter. This material for razor blades is a stainless steel consisting of 0.65% carbon, 0.25% silicon, 0.66% manganese, 13.10% chromium and the balance iron.

Figure 5:
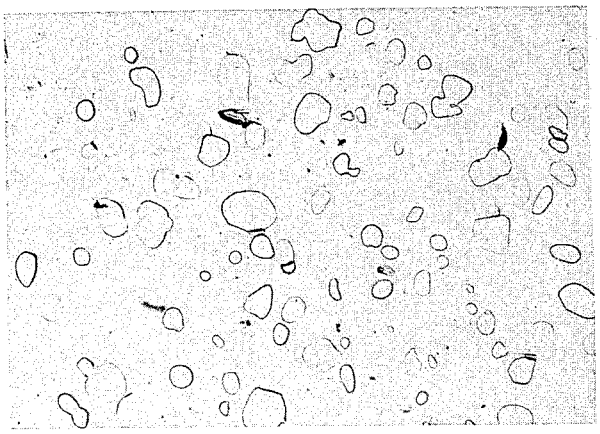
FIG. 5 is an electron microscopic picture showing the structure of a material for razor blades produced by a method of the prior art.

FIG. 5 is an electron microscopic picture, magnification 8,000 X, of a material for razor blades having a thickness of 0.10 millimeter and made of a band steel having the same chemical composition as the material for razor blades shown in FIG. 4 but treated by a conventional spheroidizing annealing method by using a furnace of the bell type.

The carbides in the band steel produced by the method according to the invention are not readily destroyed even if the band steel is rolled at a high cold rolling reduction rate, because the carbides have a small spheroidal structure of uniform size. This enables the band steel treated by the method according to the invention to withstand rolling effected at a high cold rolling reduction rate. This feature of the invention will be described in detail with reference to an example. A tool steel consisting of 1.15% carbon, 1.20% silicon, 0.40% manganese, 0.50% chromium, 1.50% tungsten and the balance iron and treated by a conventional spheroidizing annealing method using a furnace of the bell type would have a maximum cold rolling reduction rate of 35%, when production is taken into consideration. However, if the same material is treated by the method according to the invention, it will possibly have a cold rolling reduction rate of 55%.

Figure 6:
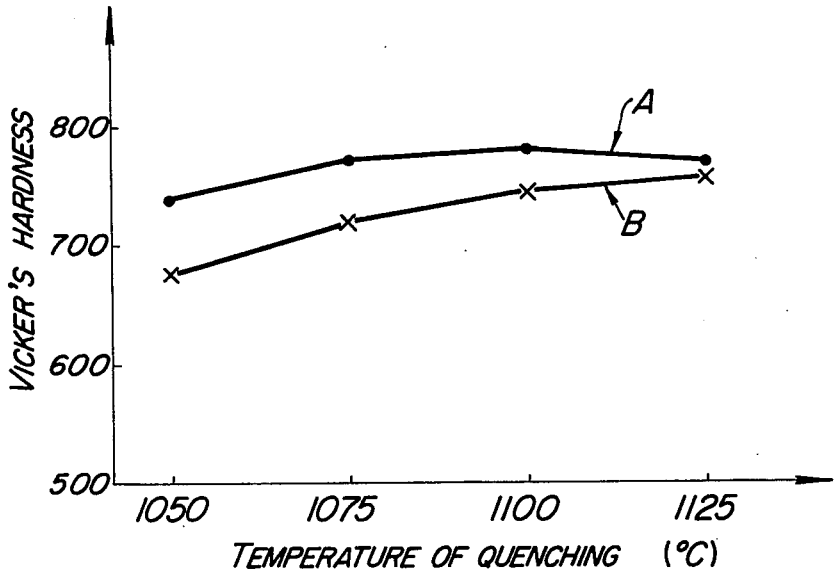
FIG. 6 is a graph showing the relation between the hardening temperatures and the hardness obtained by hardening.

FIG. 6 shows the relation between hardening temperatures holding the materials at these temperatures for 30 seconds and the hardness obtained when a material for razor blades consisting of 0.65% carbon, 0.25% silicon, 0.66% manganese, 13.0% chromium and the balance iron and having a thickness of 0.10 millimeter was subjected to heat treatment. A curve A represents a specimen of the material treated by the method according to the invention, while a curve B represents a specimen of the material subjected to a conventional spheroidizing annealing treatment by using a furnace of the bell type.

From the foregoing description, it will be appreciated that the band steel for tools and razor blades treated by the method of isothermal annealing according to the invention offers many advantages. They are set forth hereinafter.

1. The band steel contains carbides having a small sphroidal structure of uniform size.

2. It is highly susceptible to cold rolling.

3. It has even hardness throughout its length, so that adjustments of the reduction in thickness to be effected by cold rolling can be effected readily.

4. It gives freedom from decarburizing and carburizing.

5. The band steel is highly amenable to hardening, so that it is possible to obtain high hardness in a stable manner by heating it at a low hardening temperature in subjecting it to heat treatment.

6. After being subjected to heat treatment, the band steel has high touchness, high machinability and other superb properties as a material for producing tools and razor blades.

7. The band steel has a high heat treatment speed, so that it is possible to reduce the length of time required for processing it through various steps.

We claim:

1. A method of isothermal annealing of a hot-rolled band steel selected from the group consisting of a tool steel and a stainless steel comprising the successive steps of:

converting a coil of said hot-rolled band steel into an open coil with its convolutions spaced apart a distance great enough to allow a molten salt to pass therethrough;

immersing said open coil in a molten salt bath held at a temperature in a range of from 550° to 750° C for a period of 5 to 30 minutes to preheat the open coil and cause preliminary precipitation of carbides;

immersing the preheated open coil in a molten salt bath held at a temperature in a range of from a temperature immediately above $Ac_1$ point to the temperature of $Ac_1$ point plus 50° C for a period of 5 to 30 minutes to make the steel austenitic in structure;

immersing the open coil in a molten salt bath held at a temperature in a range from a temperature immediately below $Ar_1$ point to the temperature of $Ar_1$ point minus 80° C for a period of at least 10 minutes to complete the isothermal transformation and to provide a steel product containing carbides having a small spheroidal structure of uniform size and exhibiting good cold workability and hardenability;

further heating the open coil after said isothermal transformation at a temperature of 600° to 650° C for a period of three to ten minutes; and thereafter air-cooling the open coil.

2. A method according to claim 1, wherein said coil is opened to provide a space between each convolution that is a minimum of 2 mm.

3. A method according to claim 1, wherein said tool steel is a steel consisting of 1.15% carbon, 1.20% silicon, 0.4% manganese, 0.50% chromium, 1.5% tungsten and the balance iron.

4. A method according to claim 1, wherein said tool steel is a steel consisting of 1.25% carbon, 0.20% silicon, 0.20% manganese, 0.20chromium and the balance iron.

5. A method according to claim 1, wherein said stainless steel is a steel consisting of 0.65% carbon, 0.25% silicon, 0.66% manganese, 13.0% chromium and the balance iron.

* * * * *